US005615789A

United States Patent [19]

Finkelstein et al.

[11] Patent Number: 5,615,789

[45] Date of Patent: Apr. 1, 1997

[54] CAP LINER FOR HOT FILLED CONTAINER AND METHOD OF MAKING

[75] Inventors: Harvey Finkelstein, Washington Township, N.J.; Victor Flores, Goldens Bridge, N.Y.; Murray Singer, Clark; Anatoly Verdel, Fairlawn, both of N.J.

[73] Assignee: Tri-Seal International, Inc., Blauvelt, N.Y.

[21] Appl. No.: 214,273

[22] Filed: Mar. 16, 1994

Related U.S. Application Data

[63] Continuation-in-part of Ser. No. 755,733, Sep. 6, 1991.

[51] Int. Cl.[6] ..... B65D 53/04

[52] U.S. Cl. ..... 215/348; 215/347; 215/349; 428/66.4; 428/36.5; 428/319.7

[58] Field of Search ..... 428/35.2, 36.9, 428/36.91, 308.4, 304.4, 515, 516, 517, 64, 66, 36.5, 319.7; 215/347, 348, 349

[56] References Cited

U.S. PATENT DOCUMENTS

| | | | |
|---|---|---|---|
| 1,521,714 | 1/1925 | Quintal | 76/81 |
| 3,595,419 | 9/1969 | Dukess | 215/329 |
| 3,819,460 | 6/1974 | Dukess | 428/66.4 |
| 3,917,100 | 11/1975 | Dukess | 215/329 |
| 3,963,845 | 6/1976 | Dukess | 428/66.4 |
| 3,976,217 | 8/1976 | Dukess | 215/329 |
| 4,057,159 | 11/1977 | Fillmore et al. | 215/222 |
| 4,089,434 | 5/1978 | Tagalakis et al. | 215/260 |
| 4,107,247 | 8/1978 | Dukess | 264/45.9 |
| 4,121,728 | 10/1978 | Tagalakis et al. | 215/260 |
| 4,206,165 | 6/1980 | Dukess | 264/45.9 |
| 4,734,312 | 3/1988 | Sugiyama | 428/157 |
| 4,807,772 | 2/1989 | Schloss | 215/349 |
| 4,810,570 | 3/1989 | Rutien et al. | 428/318.6 |
| 4,815,240 | 3/1989 | Larson | 451/555 |
| 4,818,577 | 4/1989 | Ou-Yang | 428/36.5 |
| 4,911,978 | 3/1990 | Tsubone et al. | 428/317.9 |
| 4,935,273 | 6/1990 | Ou-Yang | 428/35.7 |
| 5,000,992 | 3/1991 | Kelch | 428/36.5 |
| 5,079,057 | 1/1992 | Heider | 428/36.5 |

*Primary Examiner*—James J. Seidleck
*Assistant Examiner*—Michael A. Williamson
*Attorney, Agent, or Firm*—Lowe, Price, LeBlanc & Becker

[57] ABSTRACT

A cap liner and method for producing a cap liner which is particularly suited for use with a cap employed on a hot filled container. The liner includes a disc having one or more outer layers and an intermediate foamed layer bonded thereto. Preferably, the outer layer is formed of a copolymer of polypropylene and polyethylene. The intermediate layer can include a homogeneous admixture of polypropylene and polyethylene or an admixture of polyethylene, a copolymer of polyethylene and polypropylene and ethylene vinyl acetate. One method for producing the cap liner involves mechanically mixing at room temperature polypropylene and polyethylene to form a desired homogeneous admixture for each layer, and then co-extruding the admixtures at approximately 320°–415° F. to form the bonded outer and intermediate layers. Another method involves extruding the copolymer outer layer to the intermediate layer admixture to form the bonded cap liner. Alternatively, the intermediate layer may be formed of foamed polyethylene.

6 Claims, 1 Drawing Sheet

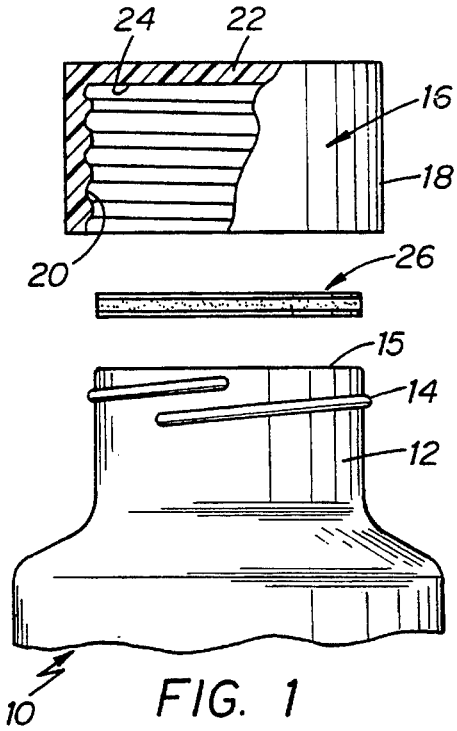
FIG. 1
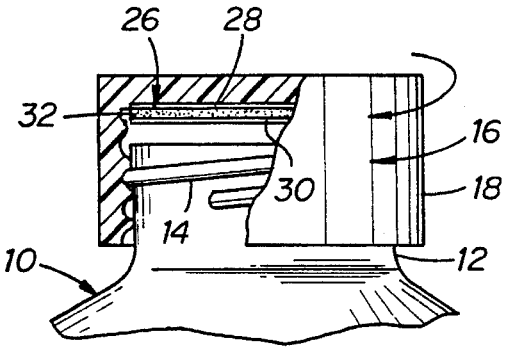
FIG. 2
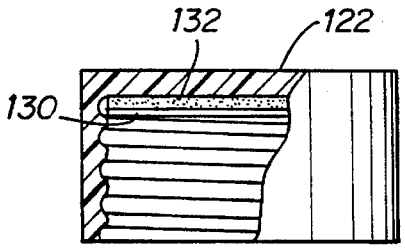
FIG. 6
FIG. 3
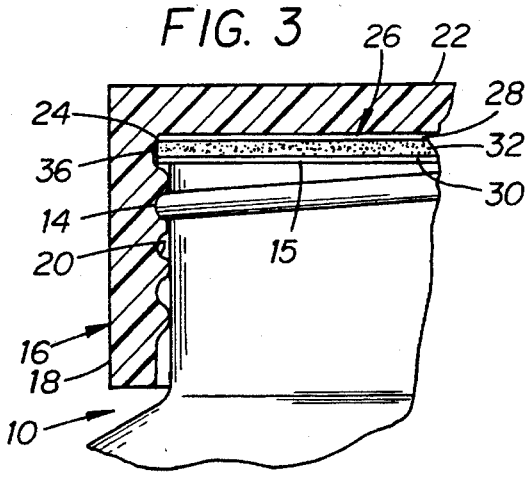
FIG. 4
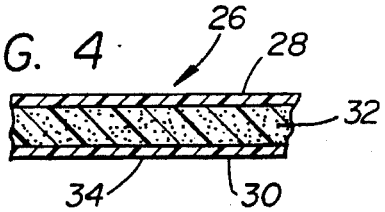
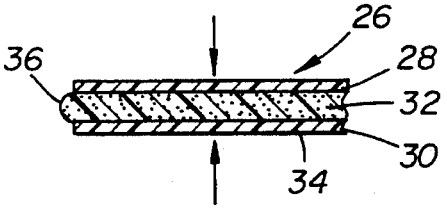
FIG. 5
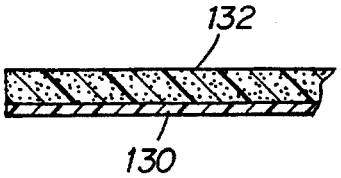
FIG. 7

CAP LINER FOR HOT FILLED CONTAINER AND METHOD OF MAKING

This is a continuation-in-part application of U.S. Ser. No. 07/755,733 filed on Sep. 6, 1991.

FIELD OF THE INVENTION

The present invention relates to a cap liner and method for producing a cap liner which is particularly suited for use with a cap employed on a hot filled container To minimize the potential for contamination, many food products and the like are packaged in containers at very high temperatures. After the heated product is put in the container, a cap preferably having a sealing liner positioned therein is used to seal the contents of the container to prevent leakage between the threaded portions of the container neck and the cap by providing a positive seal at the mouth of the container. As a result, the cap liner is often subjected to the high heat from the contained product until sufficient time elapses for the product to cool. Therefore, a need has been created for an economical cap liner which provides an effective seal for a hot filled container and does not physically or functionally degrade when exposed to heat. The cap liner and method of the present invention meet this need.

BACKGROUND ART

Various cap liners and methods of producing cap liners are known in the patented prior art as evidenced by the patents to Dukess U.S. Pat. Nos. 4,107,247, 3,819,460, 3,595,419 and 3,976,217.

Such liners have been provided as a multilayer sandwich having one or more solid low density polyethylene outer layers and a flexible and resilient foamed inner or intermediate layer of a rubber-like material such as polyethylene, ethylene vinyl acetate, or the like. Cap liners of this type have been manufactured by way of simultaneous multiple extrusion using a combination dye for bonding the layers together.

An important feature of these cap liners is that the inner or intermediate layer expands outwardly beyond the outer layer or layers upon compression between the container and the cap, thereby abutting against the side walls of the cap to produce an effective seal. Such cap liners also have the advantages of being stress and crack resistant, bendable, compressible, and impervious to moisture, chemicals and acids when formed of appropriate materials.

Although known cap liners have proved to be economical and effective for sealing containers when not exposed to heat, such liners melt and/or weaken when used with caps on hot filled containers, thereby decreasing the effectiveness of the seal. Materials such as polypropylene are strong and heat resistant and thus would be useful in cap liners for hot filled containers. Up to the present time, however, it has not been possible to bond a polypropylene layer to another layer or layers formed of polyethylene in multilayer cap liners. Also, it has been difficult to foam polypropylene so that it could be used for the intermediate foamed layer in such cap liners. As a result of these problems, polypropylene has not been used in such cap liners.

SUMMARY OF THE INVENTION

Accordingly, it is a primary object of the present invention to provide a cap liner having all of the advantages of the prior cap liners, but which does not structurally or functionally degrade when exposed to heat from hot filled containers.

Another object of the invention resides in the production of a low cost cap liner which is capable of being co-extruded as a multilayer sandwich.

Accordingly to a more particular object of the invention, the liner comprises an intermediate layer and one or more outer layers bonded thereto, the outer solid layers and/or the intermediate foamed layer including polypropylene and polyethylene which are bonded together in a unique manner.

Another object of the invention is to provide a method for manufacturing a heat resistant cap liner having a flexible and resilient intermediate foam layer and one or more outer solid layers wherein at least one layer is formed by mechanically mixing at room temperature polypropylene and polyethylene to form a homogeneous admixture, or providing a copolymer of polypropylene and polyethylene and extruding the admixture or copolymer at approximately 320°–415° F.

In another aspect of the invention, the intermediate foam layer includes a low density polyethylene, ethylene vinyl acetate (EVA) and a copolymer of polypropylene and polyethylene, preferably 70% polyethylene and 30% polypropylene.

More particularly, the method includes the step of simultaneously extruding one or more outer layers with the intermediate foam layer for bonding thereto.

BRIEF DESCRIPTION OF THE DRAWINGS

Other objects and advantages of the subject invention will become apparent from a study of the following specification when viewed in light of the accompanying drawing, in which:

FIG. 1 is an exploded, elevational view, with parts in sections illustrating the cap and liner therefor made from liner material according to the invention;

FIG. 2 is an elevational view like FIG. 1, showing the cap liner therefor in a stage of being secured on the neck of a container;

FIG. 3 is an enlarged elevational view, with parts in section and parts broken away, illustrating a portion of the cap and liner therefor as firmly secured on a container;

FIG. 4 is a partial sectional view of the liner material;

FIG. 5 is a view similar to FIG. 4 but showing the shape of the liner after it has been compressed when the cap has been tightly closed on the container;

FIG. 6 is an elevational view of a modification of the cap liner; and

FIG. 7 is a sectional view of the modified liner shown in FIG. 6.

DESCRIPTION OF THE PREFERRED EMBODIMENTS

With continuing reference to the accompanying drawing, wherein like reference materials designate similar parts throughout the various views, reference numeral 10 is used to generally designate a conventional container such as a bottle, tube or can having a neck 12 which is threaded at 14. In order to provide a closure for the container 10, a cap 16 is employed which includes cylindrical side walls 18 which are internally threaded at 20 and a top 22. A cylindrical groove 24 is formed as the uppermost of the threads 20 and is for the purpose of receiving therein a liner 26. The cap 16 is preferably molded out of any suitable synthetic plastic material and is adopted to be threadably secured on the neck 12 with the threads 20 engaging the threads 14.

As shown in FIG. 4, a liner 26 formed in accordance with the invention, comprises a sandwich of outer layers 28 and 30, and an intermediate layer 32. The liner preferably is stamped in the shape of a disc.

The outer layers 28 and 30 comprise polypropylene, thereby providing a stress resistant, crack resistant relatively non-resilient, impervious layer which does not melt or weaken when exposed to heat. More specifically, the outer layers 28 and 30 are an admixture of polypropylene and poly-ethylene, thereby enabling increased bonding strength with an intermediate layer 32 comprising polyethylene while still being unaffected by heat from hot filled containers. It has been found that the preferred admixture for the outer layers 28 and 30 is approximately 10–98% of polypropylene and the remainder of polyethylene. Depending on the composition of the intermediate layer 32, the amount of polyethylene in the outer layers 28 and 30 can be increased or decreased to enhance the bonding strength with the intermediate layer 32.

Alternatively, the outer layers 28 and 30 comprise a copolymer of polypropylene and polyethylene rather than an admixture of polyethylene and polypropylene as described above. Preferably, the copolymer comprises 70% polyethylene with the balance polypropylene. Exemplary copolymers include a Quantum 8802HO having a melt index of 8.0 g/10 min. or Aristech 4070G having a melt index of 8.5 g/10 min.

However, other copolymers may be utilized having between 10 and 90% polyethylene with the balance polypropylene. It is believed that using a copolymer rather than an admixture facilitates the extrusion process described below.

The intermediate layer 32 preferably is a resilient homogeneous foamed admixture of polypropylene and polyethylene, thereby providing a flexible and resilient, compressible layer which does not melt or weaken when exposed to heat. To obtain the desired properties, the intermediate layer 32 should be an admixture of approximately 20–80% of polypropylene and the remainder of polyethylene. It has been found that the preferred admixture is approximately 60% polypropylene and 40% polyethylene.

Previously polypropylene has not been considered to be a viable material for use in a foamed layer such as the intermediate layer 32 because it has proven to be difficult to foam. The novel admixture and method of the present invention have solved this problem.

It is noted that for certain applications, the intermediate layer may be formed of foamed polyethylene when the outer layer or layers is an admixture of polypropylene and polyethylene to provide strength and heat resistance.

In another embodiment, the intermediate foamed layer 32 is a resilient homogeneous foamed admixture of low density polyethylene, a copolymer polypropylene and EVA. Each of these components can range between 15 and 40 percent of the total weight of the homogeneous admixture. Conventional foaming agents or concentrates and carrier resins in amounts up to 5% by weight each can also be added to the admixture. Although any carrier resin or foaming agent can be used, a preferred carrier resin includes one of the foam admixture components identified above. A preferred foaming concentrate can be an AZO-based type. The foaming agent and carrier resin are preferably each 2% of the total foamed admixture.

More preferably, the EVA, low density polyethylene and copolymer polypropylene range between 25 to 35%. Most preferably, the EVA is 33% the low density polyethylene is 33% and the polypropylene copolymer is 30% with the balance the carrier resin and foam concentrate.

Preferably, the low density polyethylene has a melt index of 2.0 to 2.5 g/10 min. The copolymer polypropylene can be the same copolymer polypropylene used for the outer layer as described above, i.e., 70% polyethylene with the balance polypropylene. In its most preferred embodiment, the foam admixture has a finished density between 34 and 38 pounds per $ft^3$.

The use of EVA in the intermediate foam layer provides increased resilience over the intermediate layer comprising only polyethylene and polypropylene as described above. In conjunction with this improved resilience and resultant better sealing, the EVA-containing intermediate foam layers still have sufficient heat resistance to withstand melting or weakening when the cap lid is used in a hot filled container.

In accordance with the invention, a method for effectively and economically manufacturing a cap liner with one or more layers containing polypropylene has been provided. In accordance with the method, polypropylene and polyethylene granules are mechanically mixed together, preferably at room temperature in a tumbler or the like to form a homogeneous admixture. For the foam layer, approximately 1.5% of foam concentrate is added to the admixture to enhance the foaming process. The admixture is then extruded at approximately 320°–415° F., thereby forming a foamed or solid homogeneous layer which has superior mechanical strength and does not melt or weaken when exposed to heat. Although polypropylene is difficult to foam, the polyethylene apparently works as a catalyst to promote foaming. The polypropylene molecules become entrapped in the layer by the bonding of the polyethylene molecules acting as nucleating agents.

Preferably, outer skin layers 28 and 30 are simultaneously extruded with the intermediate layer 32 for bonding thereto to form a multilayer sandwich. The outer layers 28 and 30 are an admixture of polypropylene and polyethylene or a copolymer thereof as hereinbefore described. The various layers are brought together with a combination dye at about 320° to 415° F. for bonding within the combination dye. Because of the presence of polyethylene in both the intermediate and outer layers, with polypropylene entrapped within the polyethylene in at least the outer layer or layers, the bonding of these layers is enhanced, thereby overcoming the problem of attempting to bond a pure polyethylene layer to a pure polypropylene layer during co-extrusion. The resultant sheet material can then be stamped into desired liner shapes and sizes.

When utilizing the copolymer polypropylene outer layer with the EVA-containing foam core, the extrusion temperature ranges between 320° to 415° F. with a preferred range of 400° to 415° F. Use of the copolymer outer layer also eliminates the mixing step described above when using granules of the different polymers.

When the disc 26 is inserted in the groove 24 in a normal state it will freely rotate therein permitting for effective setting of the disc 26 within the groove 24 and effective engagement of the mouth 15 of the container 10 against the under surface 34 of the adjacent outer layer 30. Continued closure of the cap 16 causes the resilient intermediate layer 32 to be compressed to produce a tongue 36 extending beyond the peripheral edges of the outer layers 28 and 30, as shown in FIG. 3, into engagement with the inner wall of the groove 24 to provide an effective seal between the liner 26 and the cap 16. Thus, there is achieved an inner effective seal for the contents of the container 10 which does not structurally or functionally degrade when used with hot filled containers, and the cap liner 26 has superior mechanical strength while still retaining all of the desirable features of the prior cap liners.

In FIGS. 6 and 7 there is shown a modified form of the invention wherein a two-ply liner is used. The cap has its top 122 serving as the upper outer layer, there being only an intermediate liner layer 132 and a lower or outer liner layer 130.

While in accordance with the patent statute the preferred forms and embodiments of the invention have been illustrated and described, it will be apparent to those of ordinary skill in the art that various changes and modifications may be made without deviating from the inventive concepts set forth above.

We claim:

1. A cap liner in the form of a disk having an intermediate layer for positioning against the inside of the cap and a lower outer layer bonded to said intermediate layer wherein, said intermediate layer is a resilient foamed admixture of 15–40% ethylene vinyl acetate, 15–40% low density polyethylene and 15–40 percent of a copolymer comprising 10 to 90% polypropylene with the balance polyethylene, and said outer layer comprises a substantially homogenous admixture of 10–98% by weight polypropylene with the balance polyethylene.

2. The cap liner of claim 1, wherein the copolymer of said second resilient foamed homogeneous admixture includes 70% by weight polyethylene with the balance polypropylene.

3. The cap liner of claim 1, wherein said ethylene vinyl acetate, said low density polyethylene and said copolymer of said second resilient foamed admixture each range between 25 and 35% by weight.

4. The cap liner of claim 1, wherein said resilient foamed admixture contains up to 5% of a foaming concentrate and up to 5% of a carrier resin.

5. The cap liner of claim 4, wherein said ethylene vinyl acetate is about 33%, said low density polyethylene is about 33% said copolymer is about 30%, said carrier resin is about 2% and said foaming concentrate is about 2%.

6. The cap liner of claim 4, wherein said carrier resin is one of ethylene vinyl acetate, a low density polyethylene or a copolymer of 10–90% polyethylene with the balance polypropylene.

* * * * *